US007125074B2

(12) United States Patent
Real et al.

(10) Patent No.: US 7,125,074 B2
(45) Date of Patent: Oct. 24, 2006

(54) VIDEO GAME CHAIR

(76) Inventors: James K. Real, 4207 E. Camino, Mesa, AZ (US) 85205; Richard Edward Florez, Jr., 1461 Autumnwind Ct., Pittsburg, CA (US) 94565

( * ) Notice: Subject to any disclaimer, the term of this patent is extended or adjusted under 35 U.S.C. 154(b) by 0 days.

(21) Appl. No.: 10/770,960

(22) Filed: Feb. 3, 2004

(65) Prior Publication Data

US 2005/0168021 A1 Aug. 4, 2005

(51) Int. Cl.
*A47C 7/62* (2006.01)

(52) U.S. Cl. ..... 297/217.3; 273/148 B; 463/48; 297/217.4

(58) Field of Classification Search ..... 297/217.1, 297/217.3, 217.4; 273/148 B; 463/36–38, 463/46–48
See application file for complete search history.

(56) References Cited

U.S. PATENT DOCUMENTS 5,195,746 A * 3/1993 Boyd et al. ..... 463/37
5,624,156 A * 4/1997 Leal et al. ..... 297/217.3
5,807,177 A * 9/1998 Takemoto et al. ..... 463/36
5,842,715 A * 12/1998 Jones ..... 297/217.3
5,868,687 A * 2/1999 Tedesco ..... 297/188.01
5,920,034 A * 7/1999 Saka et al. ..... 174/59
5,938,282 A * 8/1999 Epple ..... 297/217.3
6,145,926 A * 11/2000 Lin ..... 297/217.3
6,206,464 B1 * 3/2001 Santa Rosa et al. .... 297/188.18
6,216,927 B1 * 4/2001 Meritt ..... 273/148 B
6,814,709 B1 * 11/2004 Schwartz et al. ..... 5/633
2001/0026087 A1 * 10/2001 Tomita ..... 297/217.4
2003/0057749 A1 * 3/2003 Buono ..... 297/217.3

* cited by examiner

*Primary Examiner*—Peter R. Brown
(74) *Attorney, Agent, or Firm*—Kenneth L Tolar

(57) ABSTRACT

A video game chair for enhancing the enjoyment of a video game includes a chair member formed of a horizontal seat portion with a backrest portion vertically extending therefrom. Adjacent each of two opposing sides of the seat portion is an adjustable arm with a game controller mounted thereon. A speaker and adjustable leg are mounted adjacent each of two opposing sides of the backrest portion. An interface box is removably attached to a lower surface of the seat portion for electrically connecting the speakers and controller to a conventional game box.

16 Claims, 3 Drawing Sheets

VIDEO GAME CHAIR

BACKGROUND OF THE INVENTION

The present invention relates to a uniquely designed chair that enhances the comfort and experience of a video game player.

DESCRIPTION OF THE PRIOR ART

Video games have long been a popular form of entertainment. The games are typically operated by one or more controllers which are either held in one's hands or are supported on a table, floor or other surface. Manipulating such controllers is cumbersome and uncomfortable for the operator. Accordingly, there is currently a need for a device that allows a user to more conveniently operate a video game. The present invention satisfies this problem by providing a uniquely designed chair that allows a user to comfortably operate and enjoy a video game.

SUMMARY OF THE INVENTION

The present invention relates to a chair specifically designed to enhance the experience of a video game player. The device comprises a chair member including a horizontal seat portion with a backrest portion vertically extending therefrom. Both the seat portion and backrest portion are preferably encapsulated with a padded foam material for enhanced comfort. Adjacent each of two opposing side edges of the seat portion is a tubular frame member with a padded armrest mounted thereon. Attached to each frame member is an elongated adjustable arm having a game controller mounted thereon. Mounted along each of two opposing side edges of the backrest portion is an elongated adjustable leg having a speaker mounted on an upper end thereof. The speakers are suspended at a height typically corresponding to that of a player's ears when the player is seated in the chair.

A game interface box is mounted on the lower surface of the seat portion. The interface box is received within a protective case having straps secured thereto allowing the case to be removed from the seat portion, if desired. The case includes a releasable flap that selectively exposes a plurality of interface jacks. Embedded within the seat portion and/or backrest portion are vibrating pads that are electrically connected to the interface box. The game controller and speakers are likewise in communication with the interface box via cables that extend through the respective adjustable arms and legs. The interface box also includes a select jack for connecting the box to a conventional game controller. Accordingly, the armrest mounted game controllers can then be used to control the various functions associated with the video game. Furthermore, the various special effects emitted by the game box will be directed to the chair via the interface box. For example, any sounds associated with the video game will be emitted through the speakers. Additionally, if the game or game box includes means for creating a vibration, an appropriate signal will be directed to the vibrating pads via the interface box to cause a vibration within the seat and/or backrest portions.

It is therefore an object of the present invention to provide a game chair that significantly enhances a video game player's experience.

It is another object of the present invention to provide a game chair that provides a relaxing and comfortable means for playing a video game.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
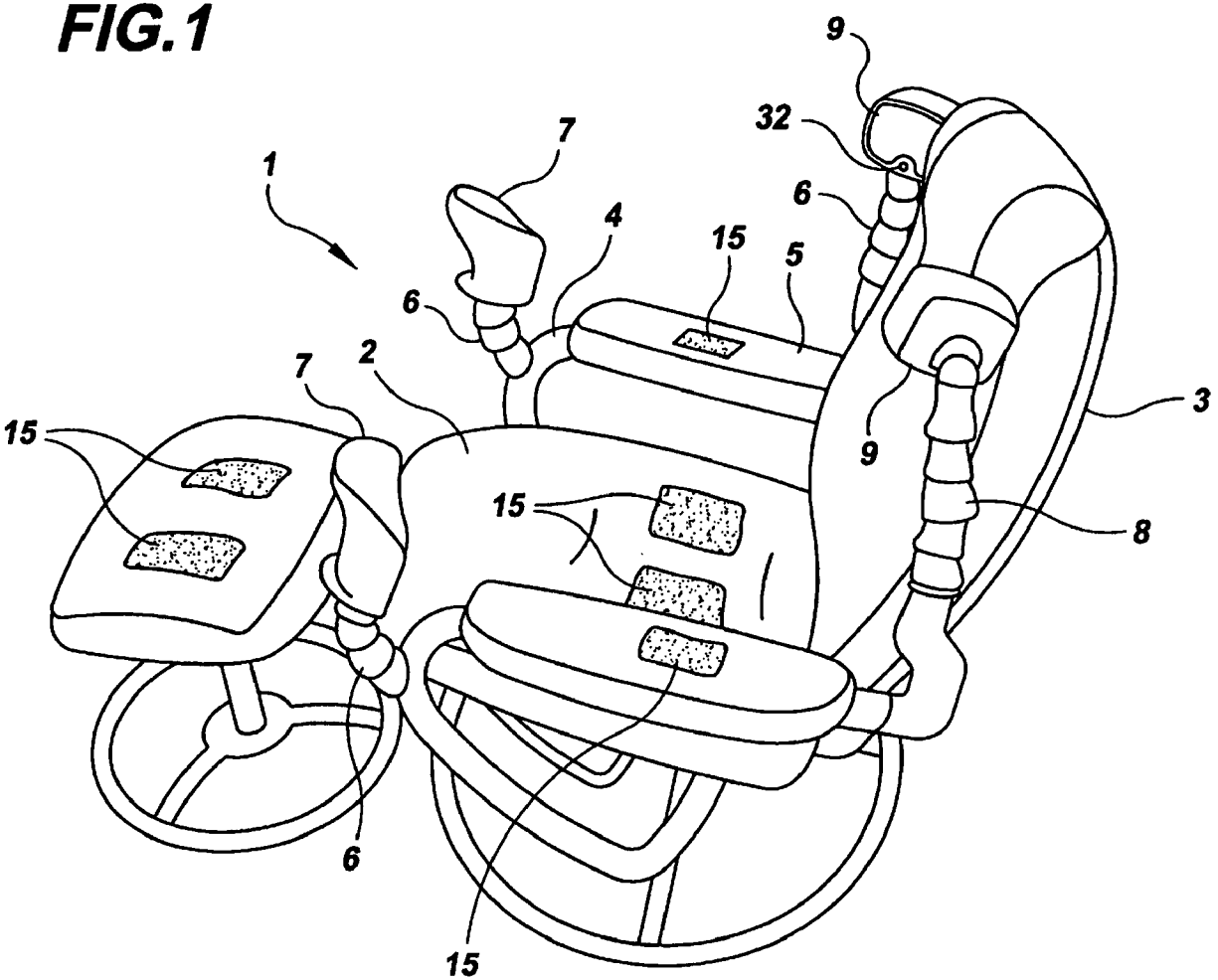
FIG. 1 is a perspective view of the game chair.
Figure 2:
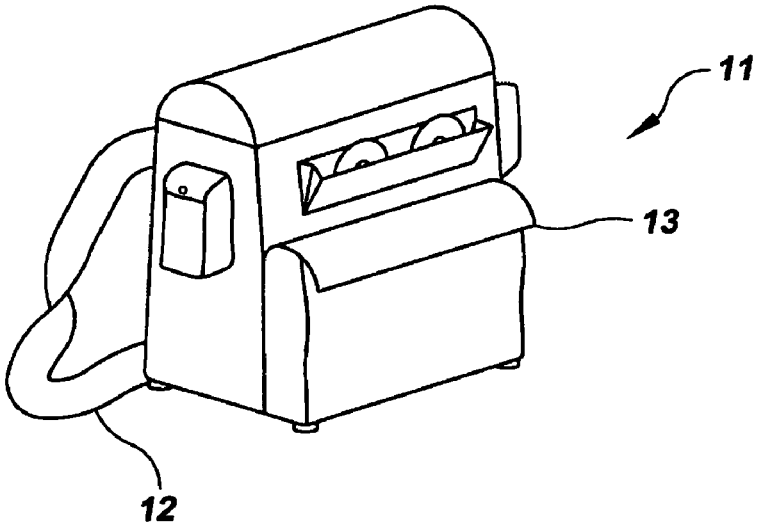
FIG. 2 depicts the game interface box received within its protective case.
Figure 3:
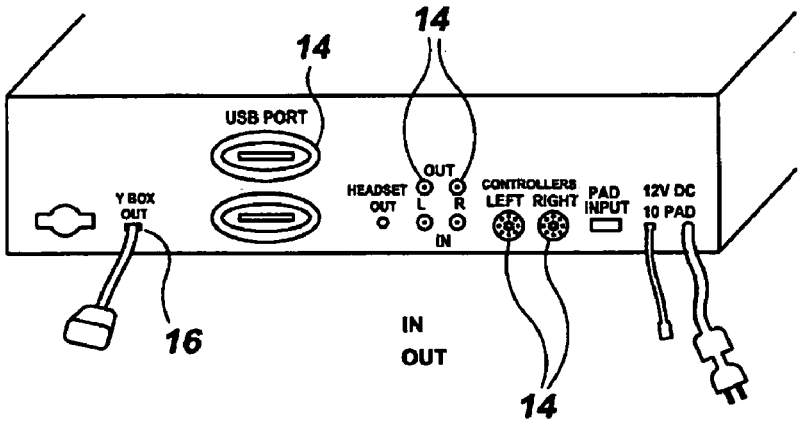
FIG. 3 is a partial view of the interface box depicting the various interface jacks.
Figure 4:
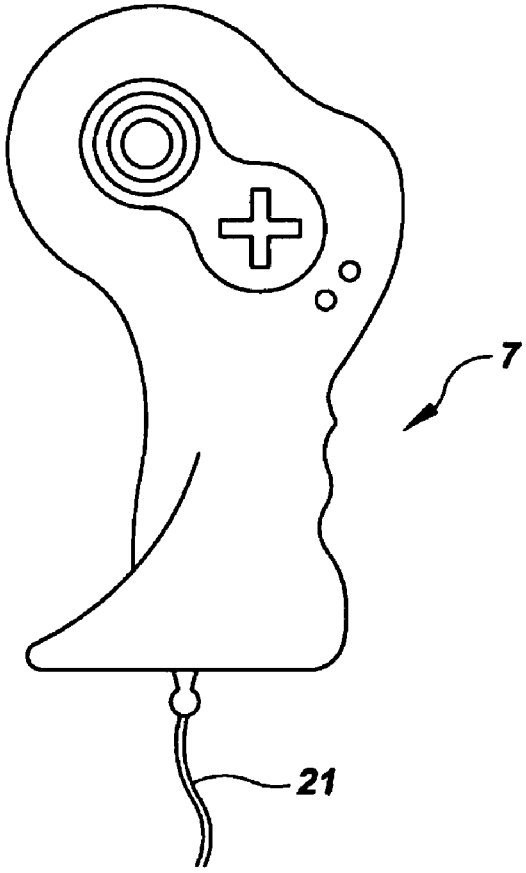
FIG. 4 is a plan view of a game controller according to the present invention.
Figure 5:
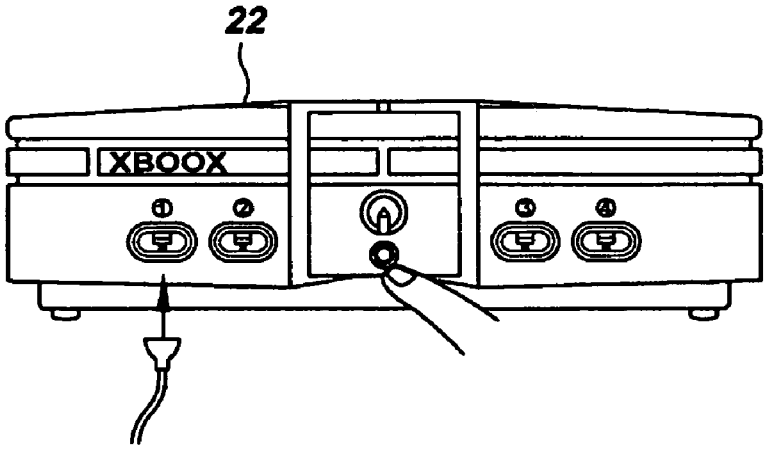
FIG. 5 depicts a typical game box for use with a game chair according to the present invention.

The present invention relates to a chair specifically designed to enhance the experience of a video game player. The device comprises a chair member 1 including a horizontal seat portion 2 with a backrest portion 3 vertically extending therefrom. Both the seat portion and backrest portion are preferably encapsulated with a padded foam material for enhanced comfort.

Adjacent each of two opposing side edges of the seat portion is a tubular frame member 4 with a padded armrest 5 mounted thereon. Attached to each frame member is an elongated adjustable arm 6 having a conventional game controller 7 mounted thereon. Each controller includes a ball on a lower surface thereof that snaps into a mating receptacle on the arm. The adjustable arm is conventional and includes multiple interlinked segments each fixable in a select position relative to an adjacent segment allowing the orientation of the arm to be varied and fixed in the selected position.

Extending from a rear end of each armrest is an elongated adjustable leg 8 having a speaker 9 mounted on an upper end thereof. The speakers are suspended at a height generally corresponding to that of a player's ears when the player is seated in the chair. A game interface box 10 is mounted on the lower surface of the seat portion. The interface box is received within a protective case 11 having straps 12 secured thereto allowing the case to be removably attached to the seat portion. The case includes a releasable flap 13 that selectively exposes a plurality of interface jacks 14.

Many conventional video game controllers include a vibrating pad received therein that is activated by a video game box upon the occurrence of a predetermined game event. The intensity of the vibration varies according to a select game being played and/or the event that is occurring. Similarly, the present invention includes vibrating pads 15 embedded within the seat portion and/or backrest portion that are electrically connected to the interface box. Preferably, multiple vibrating pads are included that are activated according to the signal received from the game box. For example, a minimum signal can activate one or more pads, while an intermediate signal will simultaneously activate additional pads. Finally, a maximum signal will activate all pads. Similar varying intensity vibrators are included in the controllers.

The game controllers and speakers are likewise in communication with the interface box via cables 21 that extend through the respective adjustable arms and legs. The interface box also includes a select jack 16 for connecting the box to a conventional game controller 22. Accordingly, the armrest mounted game controllers can then be used to control the various functions associated with the video game. Furthermore, the various special effects emitted by the game box will be directed to the chair via the interface box. For example, any sounds associated with the video game will be emitted through the speakers. Additionally, if the game or game box includes means for creating a vibration, an appropriate signal will be directed to the vibrating pads and controllers via the interface box to cause a vibration within the chair or controllers.

The interface box will also include auxiliary jacks for connecting various accessory items such as headphones, steering wheels, flight controls, shooting accessories, vibrating armrests or vibrating ottomans. Furthermore, LED'S 32 can be mounted on the chair member, preferably on the speakers, which are activated simultaneously with the vibrating pads. One or more cup holders may also be included.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A video game chair comprising:

a chair member having a seat portion and a backrest portion extending therefrom, said seat portion having a pair of opposing sides, each side with an armrest mounted thereon; an elongated, adjustable arm mounted on each armrest;

a video game controller attached to each arm whereby said arm allows the controller to be selectively positioned relative to a player; each of said controller including a ball on a lower surface that snaps into a mating receptacle on the arm;

an interface means mounted on said chair member for establishing electrical communication between said controllers and a video game box;

a pair of speakers attached to said chair member and in communication with said interface means for emitting special sound effects associated with a video game.

2. The chair according claim 1 wherein said speakers are each fastened to an elongated adjustable leg allowing the speaker to be selectively positioned relative to a player.

3. The chair according claim 1 further comprising at least one vibrating pad embedded within said seat portion, said pad electrically connected to said interface means which is activated in response to a discrete signal from said video game box.

4. The chair according claim 3 further comprising at least one vibrating pad embedded within each of said video game controllers.

5. The chair according claim 4 wherein said speakers include LED's thereon that are electrically connected to said interface means which are activated according to a discrete signal from said video game box.

6. The chair according claim 5 wherein said LED's are activated simultaneously with the vibrating pads.

7. The chair according claim 1 wherein said interface means comprises a junction box having a plurality of interface jacks thereon each for receiving an electrical cable to interconnect a game box with said speakers and said controllers.

8. The chair according to claim 7 wherein said junction box is received within a case, said case having a pair of securable straps thereon for removably attaching said case to said chair.

9. The chair according claim 8 wherein said case includes a releasable flap that exposes said interface jacks.

10. A video game chair comprising:

a chair member having a seat portion and a backrest portion extending therefrom, said seat portion having a pair of opposing sides, each side with an armrest mounted thereon;

an elongated, adjustable arm mounted on each armrest;

a video game controller attached to each arm whereby said arm allows the controller to be selectively positioned relative to a player;

an interface means mounted on said chair member for establishing electrical communication between said controllers and a video game box.

a pair of speakers attached to said chair member and in communication with said interface means for emitting special sound effects associated with a video game wherein said speakers are each fastened to an elongated adjustable leg allowing the speaker to be selectively positioned relative to a player; said speakers further including LED's thereon that are electrically connected to said interface means which are activated according to a discrete signal from said video game box;

at least one vibrating pad embedded within said seat portion, said pad electrically connected to said interface means which is activated in response to a discrete signal from said video game box.

11. The chair according claim 10 wherein each of said controllers includes a ball on a lower surface that snaps into a mating receptacle on the arm.

12. The chair according claim 10 further comprising at least one vibrating pad embedded within each of said video game controllers.

13. The chair according claim 12 wherein said interface means comprises a junction box having a plurality of interface jacks thereon each for receiving an electrical cable to interconnect a game box with said speakers and said controllers.

14. The chair according to claim 13 wherein said junction box is received within a case, said case having a pair of securable straps thereon for removably attaching said case to said chair.

15. The chair according claim 14 wherein said case includes a releasable flap that exposes said interface jacks.

16. The chair according to claim 10 wherein said LED's are activated simultaneously with the vibrating pads.

* * * * *